United States Patent [19]

Didtel

[11] 4,297,070

[45] Oct. 27, 1981

[54] APPARATUS FOR AUTOMATICALLY DEPOSITING A LOAD IN A PREDETERMINED POSITION

[75] Inventor: Stuart R. Didtel, Gresham, Oreg.

[73] Assignee: Cascade Corporation, Portland, Oreg.

[21] Appl. No.: 108,802

[22] Filed: Dec. 31, 1979

[51] Int. Cl.[3] ..... B66F 9/075

[52] U.S. Cl. ..... 414/497; 414/661

[58] Field of Search ..... 414/434, 437, 439, 497, 414/661, 704

[56] References Cited

U.S. PATENT DOCUMENTS

| | | | |
|---|---|---|---|
| 2,531,560 | 11/1950 | De Wall | 414/439 |
| 2,709,531 | 5/1955 | Mercier et al. | 414/661 X |
| 2,993,610 | 7/1961 | Kughler | 414/661 |
| 3,110,148 | 11/1963 | Mader et al. | 414/437 X |
| 3,179,198 | 4/1965 | Hastings | 180/65 R |

FOREIGN PATENT DOCUMENTS

| | | | |
|---|---|---|---|
| 673602 | 7/1979 | U.S.S.R. | 414/497 |

*Primary Examiner*—James L. Rowland

*Attorney, Agent, or Firm*—Chernoff & Vilhauer

[57] ABSTRACT

An apparatus for a lift truck, of the type equipped with a push frame, for extending the push frame at a predetermined speed of extension with respect to the lift truck while simultaneously causing the lift truck to move rearwardly at a predetermined reverse speed equal to the speed of extension of the push frame so as to deposit a load in a predetermined position. The apparatus is actuated automatically in response to extension of the push frame.

32 Claims, 3 Drawing Figures

APPARATUS FOR AUTOMATICALLY DEPOSITING A LOAD IN A PREDETERMINED POSITION

BACKGROUND OF THE INVENTION

This invention relates to improvements in apparatus for depositing a load from a lift truck, of the type equipped with a push frame, so that such load may be deposited in a predetermined position and at a predetermined speed without requiring any substantial level of skill on the part of the lift truck operator.

In the past, it has been particularly difficult for lift truck operators to center a load squarely atop another load of similar size, or otherwise deposit a load precisely in a predetermined position, when utilizing a push frame to push the load forwardly off of the load-carrying forks or platen of the lift truck. The problem arises from the fact that it is most difficult to hold the load stationary above the desired deposit position while pushing it forwardly off of the forks since, in order to do so, the lift truck must be driven in reverse at the same speed at which the push frame is extended relative to the lift truck. Such precise synchronization of two separately controllable variable functions, i.e. speed of extension of the push frame and reverse speed of the lift truck, are beyond the capability of all but the most experienced lift truck operators.

Mercier et al U.S. Pat. No. 2,709,531 suggests one type of solution to this problem. This patent discloses a lift truck push frame extension apparatus which is selectively extensible in response to the reverse travel of the lift truck by selective engagement of a clutch through which the wheels drive the push frame extension apparatus. Because the push frame extension apparatus is driven by the wheels the speed of extension is therefore dependent upon the rearward speed of travel of the truck, the mechanical drive linkage from the wheels being such as to cause the speed of extension of the push frame to equal rearward truck speed. However the foregoing basic principle of operation of the Mercier et al system, i.e. the accomplishment of speed equalization by supplying the power for push frame extension from the lift truck wheels, has a number of drawbacks which render the Mercier principle of operation impractical in modern materials handling applications.

One major drawback is that the push frame cannot alternatively be extended independently of vehicle reverse motion. Since there are many load-handling operations which require such independent extension of the push frame for proper load positioning (for example when handling loads of variable size or when obstacles prevent the lift truck from assuming a position of close proximity to the desired deposit location), such limitation is unacceptable.

In addition a system, such as that shown in the Mercier et al patent, which merely equalizes the speed of extension of the push frame with the reverse speed of the lift truck does not control the magnitude of the speed at which the load is deposited. This is still left to the operator whose lack of experience can permit him, for example, to perform the load deposit operation too rapidly for a fragile type or high weight of load which might be involved, and thereby possibly cause load damage, mispositioning of the load or a disturbance of the stability of the load stacks.

Furthermore such a system requires a clutch-engagement step prior to actuating the depositing function.

Such extra step consumes time which, under modern conditions of high-volume materials handling, is multiplied many times and decreases the overall efficiency of the handling operation. Moreover, any extra preparatory step is susceptible to being inadvertently omitted prior to moving the lift truck rearwardly, in which case the lift truck would have to be repositioned and the procedure repeated.

Finally, a great many lift truck push frames are now equipped with slip sheet clamps, the clamping and release of which are interrelated with the extension and retraction apparatus of the push frame in such a way as to cause variable time delays between actuation of the extension apparatus and actual extension of the push frame, thereby making it much more difficult to achieve speed and movement synchronization of the push frame and lift truck unless the power sources for the two functions are separate from one another.

It should be noted that different types of agricultural equipment, such as those shown for example in De Wall U.S. Pat. No. 2,531,560 or Mader et al U.S. Pat. No. 3,110,148 have been devised in the past which also have load-pushing mechanisms powered by, and therefore synchronized with, the wheels of the vehicle. However these essentially operate on the same principle as that of the Mercier et al patent, and therefore do not suggest solutions to the foregoing problems.

What is needed therefore is an improved lift truck load-depositing apparatus which not only equalizes and synchronizes the speed of push frame extension with the reverse speed of the lift truck to obtain precise positioning of a deposited load, but which in addition provides separately operable power sources for lift truck movement and for extension of the push frame respectively, provides not only equal truck and push frame speeds but also a predetermined fixed magnitude of such speeds, operates automatically in response to actuation of push frame extension rather than in response to lift truck rearward motion and provides the necessary synchronization of lift truck and push frame movement despite time delays inherent in the extension of the push frame due to the presence of a slip sheet clamp release function.

SUMMARY OF THE PRESENT INVENTION

In the present invention all of the foregoing drawbacks of the prior art are overcome primarily by the utilization of a different principle of speed equalization and synchronization between push frame extension and lift truck reverse movement. The different principle of operation employed also provides an additional advantage in that existing, conventional lift trucks equipped with push frames can be easily retrofitted to utilize the invention by the addition of a relatively simple accessory unit to the lift truck.

Since lift trucks equipped with push frames conventionally have separate power systems for driving the lift truck and extending the push frame respectively (i.e. a motor for driving the wheels and a hydraulic cylinder for extending and retracting the push frame), each being completely separately controllable and thus totally unsynchronized with the other, the present invention retains these separate power systems and their separate controllability so that the push frame can be extended in the absence of vehicle reverse motion simply by actuation of the push frame hydraulic cylinder. The apparatus for equalizing the push frame extension and lift truck reverse speeds, rather than utilizing a principle wherein one power system drives both functions, provides a push frame speed controller interconnected with the hydraulic cylinder for fixing the speed at which the hydraulic cylinder extends the push frame relative to the lift truck, and also provides a lift truck speed controller connected to the truck drive motor which, when actuated, fixes the normally variable speed at which the motor drives the lift truck rearwardly at a fixed, predetermined speed substantially equal to the fixed speed of extension of the push frame. Not only do such speed controllers permit the retention of the two separate power systems, but actually preset the magnitude of the speed at which the load will be deposited, thereby not only relieving the lift truck operator of responsibility for push frame and lift truck speed equalization but also relieving him of the responsibility for controlling the magnitude of these speeds. Moreover, the speed controllers of the invention are adjustable so as to provide for different speed settings, depending upon the particular type, weight, etc. of loads normally involved in a particular materials handling operation.

Rather than requiring multiple actuation steps to employ the speed setting and equalization system of the present invention, a synchronizing apparatus responsive to actuation of the hydraulic cylinder to extend the push frame is provided which initiates reverse motion of the lift truck at the predetermined speed setting automatically in response to the operator's actuation of the push frame to extend it. Accordingly, rather than the system being actuated by reverse motion of the lift truck as in the prior art, the system is instead actuated more appropriately by the actuation of the push frame hydraulic cylinder since system operation would be desired only during extension of the push frame. In the absence of push frame extension, the system exercises no control over the lift truck drive motor and the lift truck is capable of normal selective forward and reverse operation at variably controlled speed.

The present invention also compensates for the conventional time delay between actuation of the hydraulic cylinder to extend the push frame and actual extension thereof, caused by the requirement of most such extension apparatus to release a slip sheet clamp prior to extension of the push frame. This compensation is accomplished by means of a variably adjustable time delay which delays the actuation of the speed equalization and direction control system by a predetermined time period after actuation of the hydraulic cylinder to extend the push frame.

For those circumstances where extension of the push frame without reverse motion of the lift truck is desired, means are provided for easily disconnecting the drive motor speed equalization and direction control functions from the push frame extension apparatus so that the drive motor is not controlled automatically in response to push frame extension.

It is accordingly a primary objective of the present invention to provide an apparatus for automatically equalizing push frame extension speed and lift truck reverse speed which is compatible with maintaining separately-controllable, independent power sources for push frame extension and lift truck travel respectively.

It is a further primary objective of the invention to provide such an apparatus which not only equalizes push frame extension speed and lift truck reverse speed, but also fixes such speeds at a predetermined magnitude.

It is a further objective of the present invention that such predetermined magnitude of the speeds be adjustable for different load-handling conditions.

It is a further primary objective of the invention to make actuation of the foregoing apparatus responsive automatically to actuation of the push frame to extend it.

It is a further objective of the invention to provide apparatus for delaying such automatic actuation by a predetermined time period after actuation of the push frame to extend it, so as to compensate for the time necessary to release a slip sheet clamp.

It is a further objective of the invention to provide means for selectively preventing such automatic actuation when desirable.

It is a further primary objective of the invention that the apparatus be adapted for installation as an accessory to existing lift trucks equipped with push frames so that they may be retrofitted to accomplish the foregoing objectives.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
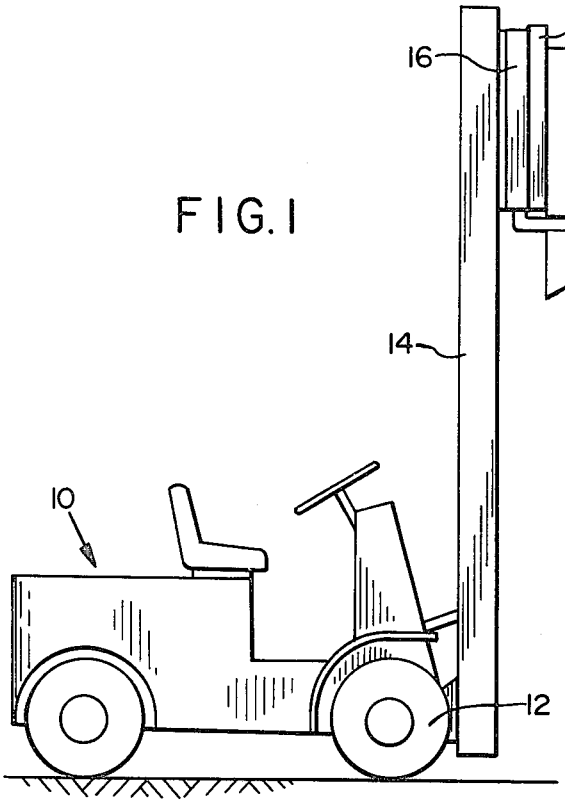
FIG. 1 is a side view of an exemplary lift truck equipped with a push frame, shown supporting a load in position for deposit atop another load.

FIG. 1 depicts a typical electric lift truck 10 having drive wheels 12, driven by an electric motor to be discussed hereafter, for moving the lift truck selectively forwardly and rearwardly. A load-lifting mast 14 is mounted at the front of the lift truck 10 and has a load carriage 16 mounted thereon so as to move vertically. The load carriage 16 in turn has a load-carrying member, such as a platen or a pair of load-carrying forks 18 (only one of which is shown), for supporting a load 20 and a selectively extensible and retractable push frame 22 mounted thereon. In many cases the push frame 22 will be equipped with a slip sheet clamp extending transversely along its bottom edge (not shown), such slip sheet clamp being automatically closable in response to retraction of the push frame and automatically openable in response to extension of the push frame. Extension of the push frame 22 to push a load forwardly off of the forks 18, or retraction thereof to pull a load rearwardly onto the forks, is accomplished by a pantographic linkage 24 (FIG. 2) powered by a selectively extensible and retractable hydraulic cylinder to be explained more fully hereafter.

Figure 3:
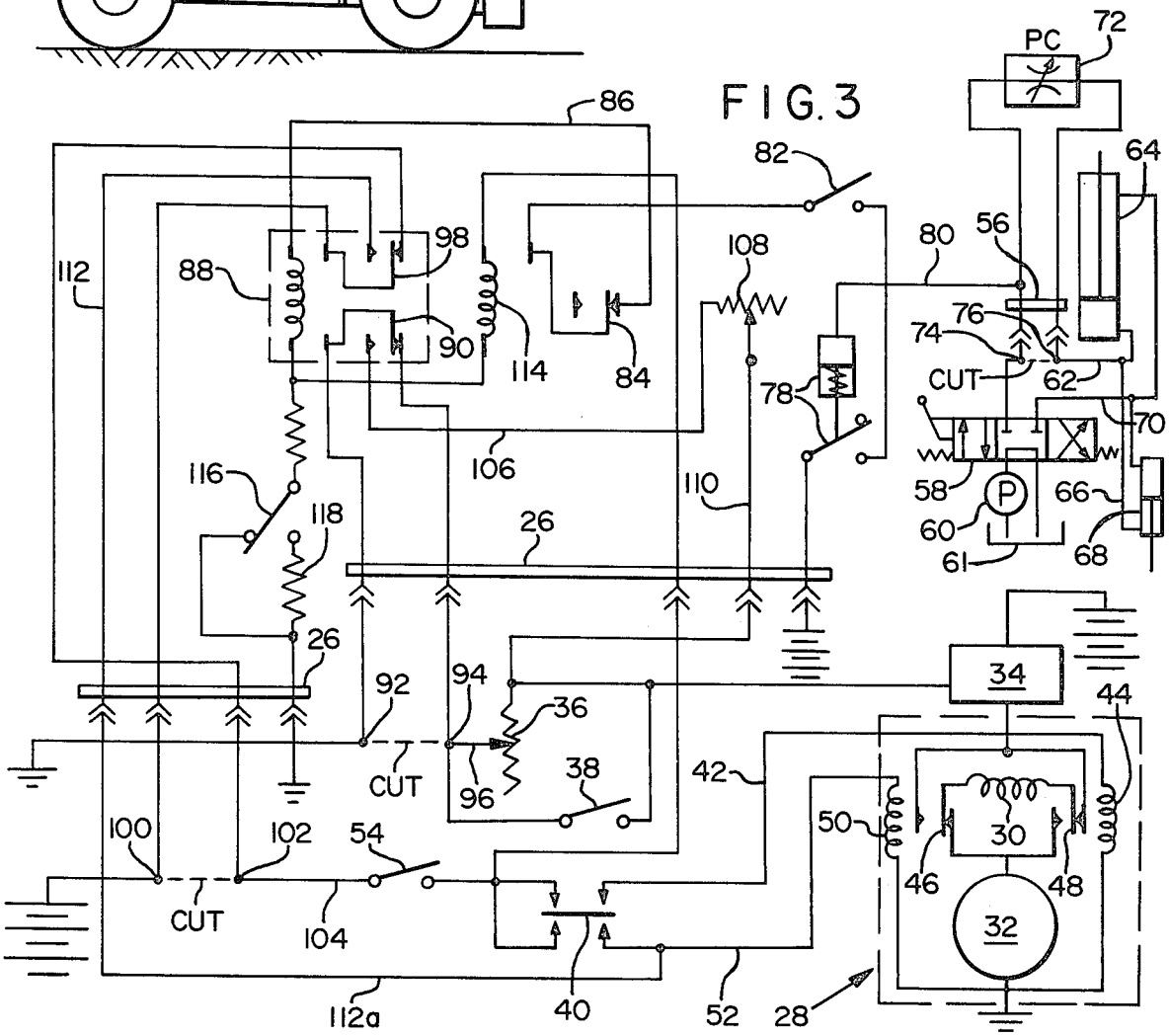
FIG. 3 is a schematic diagram showing simplified exemplary electrical drive motor and hydraulic push frame circuits of the lift truck of claim 1, as modified by the addition of an accessory which changes the operation of such electrical and hydraulic circuits in accordance with the present invention.

With reference to FIG. 3, the electrical drive circuit of a typical electric lift truck such as 10 is shown in simplified form as that portion of the figure connected below the electrical junction panels 26 and is entirely conventional except for the two electrical conductor interruptions which have been labeled with the notation "cut", and the addition of a line 112*a*. In order best to understand the operation of the present invention, the normal operation of the lift truck electric drive circuit will first be explained. An electric drive motor indicated generally as 28 is composed of a field 30 and armature 32 and is connected by a conventional mechanical drive train (not shown) to the drive wheels 12. Speed of the lift truck is controlled by a conventional silicon controlled rectifier (SCR) 34 inserted between the truck battery and drive motor 28. The SCR is a solid state rectifier with silicon as the primary semiconductor material which operates as a high-speed switch which provides the motor with battery voltage in variable bursts or pulses, resulting in a variable average voltage applied to the motor which varies its speed and thus the speed of the lift truck 10. SCR pulse variation in turn is controlled by a variable resistor 36 controllably connected to the lift truck operator's accelerator pedal. When full power is required by the operator, full depression of the accelerator pedal closes a switch 38 which bypasses the variable resistor 36.

The direction in which the motor 28 is driven, and thus the direction of the truck, is determined by an operator-controlled forward-reverse switch 40. When moved to its upper position, switch 40 completes a circuit through line 42 which energizes relay 44 moving the associated switches 46 and 40 to their right-hand positions as shown in FIG. 3 causing current to flow through motor field 30 in a direction so as to drive the lift truck forwardly. Alternatively, if switch 40 is moved to its lower position, it energizes relay 50 through line 52 causing switches 46 and 48 to move to the left and thereby causing current to flow through field 30 in the opposite direction, thereby driving the lift truck rearwardly. Switch 54 is controlled by the accelerator and is closed, permitting completion of a circuit through switch 40, only if the accelerator is at least partially depressed.

Also in FIG. 3 is a simplified portion of the hydraulic circuit of the lift truck 10 by which the extension and retraction of the push frame 22 is accomplished, shown connected below a hydraulic junction panel 56. This portion of the lift truck's hydraulic circuit is completely conventional except for the interruption in the hydraulic line 62 indicated by the notation "cut". In normal operation, extension of the push frame 22 is accomplished by movement of the spool of the manually-controlled hydraulic valve 58 to the right as shown in FIG. 3. This actuates a battery-driven electric pump 60 through a conventional switching circuit (not shown), causing the pump 60 to draw hydraulic fluid from reservoir 61 and supply it under pressure through conduit 62 to extend hydraulic cylinder 64. The piston rod of the cylinder 64 is connected to the pantographic linkage 24 in a conventional manner and extends the linkage and push frame 22. If the lift truck 10 is equipped with a slip sheet clamp, movement of the valve 58 to the right initially causes the pressurized fluid supplied to conduit 62 to be supplied through conduit 66 to retract a slip sheet clamp cylinder 68, thereby releasing the slip sheet clamp. Because substantially less pressure is required to release the slip sheet clamp than is required to extend the push frame 22, initial retraction of the slip sheet clamp cylinder 68 will precede initial extension of the push frame cylinder 64 by a time period necessary to cause full retraction of the cylinder 68. This time period will depend upon the flow rate of hydraulic fluid through line 62. Conversely, movement of the spool of valve 58 to the left in FIG. 3 introduces pressurized fluid into conduit 70 and causes retraction of the cylinder 64 and push frame 22, preceded by extension of cylinder 68 to close the slip sheet clamp.

Figure 2:
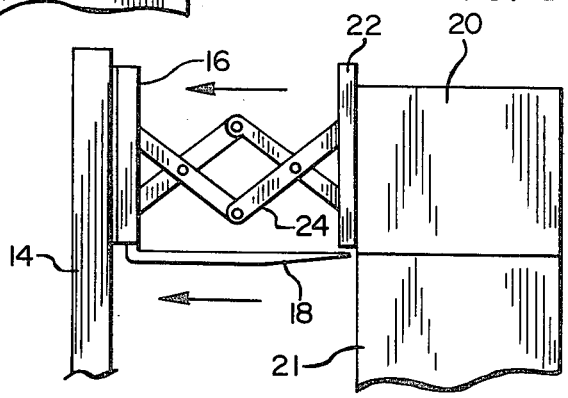
FIG. 2 is a partial side view of the lift truck of FIG. 1 showing the relationship of the lift truck and push frame with respect to the load after the load has been deposited properly in position atop the other load.

From the foregoing discussion of the lift truck's conventional electrical drive and hydraulic push frame circuits, it will be appreciated that the two systems are controllable totally independently of one another. That is, speed and direction of the lift truck are controlled solely by the operator's depression of the accelerator pedal and his manual control of switch 40, while speed and direction of the push frame 22 relative to the lift truck are controlled manually by the selective movement and modulation of valve 58. The independent operation of these two systems, for reasons discussed earlier, is highly desirable and useful in many circumstances and should be retained. However, when a lift truck operator wishes to deposit a load 20 atop another load 21 as shown in FIGS. 1 and 2, or otherwise deposit the load precisely in a predetermined position, such independent operation of the two systems requires an unusually high degree of skill on the part of the operator to accurately deposit the load 20 squarely atop the load 21. Conventionally the operator would drive the lift truck 10 forwardly until the load 20 were positioned as shown in FIG. 1, and then would extend the push frame 22 while simultaneously driving the lift truck rearwardly as shown in FIG. 2 to accomplish the deposit. It will be appreciated that this maneuver requires simultaneous modulation of the valve 58 and lift truck accelerator in such a manner as to cause the reverse speed of the truck to equal the speed of extension of the push frame relative to the lift truck. Unfortunately, in most high-volume load-handling operations, the experience level of the average lift truck operator is insufficient to accomplish this maneuver successfully and efficiently.

Accordingly, according to the present invention, an accessory is added to the lift truck 10 modifying the conventional electrical drive and hydraulic push frame circuits previously discussed with respect to FIG. 3. The circuit portions added by the accessory are shown in the portions of FIG. 3 connected above the electrical junction panels 26 and hydraulic junction panel 56 respectively. Installation of the accessory also involves cutting of the lift truck's electrical and hydraulic conduits at the three places indicated by the notation "cut", and adding an electrical conduit 112*a*.

The hydraulic portion of the accessory preferably comprises a variably-adjustable, pressure-compensated flow-control valve 72 of a conventional type which is interposed between junctions 74 and 76 formed by the cut in hydraulic conduit 62 through which fluid is fed for extending cylinder 64 and push frame 22. Valve 72 fixes, at a predetermined volumetric flow rate, the flow of fluid through line 62 irrespective of the modulation of valve 58 or the load on the cylinder 64, thereby setting the speed of extension of the push frame 22 relative to the lift truck at a fixed predetermined speed which can be adjusted only by adjustment of the variable flow-control valve 72. It will be appreciated that equivalent methods of fixing the speed of extension of the push frame 22 are also possible, such as installing an adjustable stop on the operator control handle for valve 58 and, by thus controlling the degree to which the valve can be opened to cause extension of the push frame 22, thereby controlling the speed of extension in a manner substantially equivalent to that accomplished by the flow-control valve 72 (except that in the latter case speed of extension could be somewhat variable with varying loads). Equivalent results would also be obtainable by providing a pump 60 which has a variably preset controlled flow (either by displacement or speed control), in which case valve 58 would be substantially incapable of modulation. However the flow control valve 72 is considered preferable to these alternatives due to its ease of connection to the lift truck's hydraulic circuit, its adaptability for inclusion as part of a unitized accessory, and its independence of load variations.

The accessory also includes a hydraulically-controlled synchronizing switch 78 which is spring-biased to its open position but which closes automatically in response to the sensing of pressure, through pilot line 80, at the inlet side of flow control valve 72, such pressure indicating the actuation by the operator of valve 58 to extend the push frame. Equivalent results could be accomplished alternatively, for example, by an electrical relay switch installed at the position of switch 78 actuated by another switch attached to valve 58 which energizes the relay in response to operation of the valve 58 to extend the push frame. However the hydraulic synchronization provided by switch 78 requires no extra installation and is therefore preferable if speed of extension of the push frame is to be controlled by a flow-control valve such as 72 as part of the accessory.

Closure of switch 78 in response to actuation of valve 58 to extend the push frame 22 completes a circuit through normally-closed switches 82 and 84 and line 86 through a double switch, time-delay relay assembly 88. Relay assembly 88 may, for example, be a conventional solid state time-delay relay such as a model TIK-10-462 manufactured by National Controls Corporation of Lombard, Illinois having a variable time-delay setting of 0.1–10 seconds. It will be noted that one of the switches 90 of the relay 88 is interposed between junctions 92 and 94 formed by the cut in line 96 of the lift truck's drive speed control circuit. Switch 90 is referred to herein as a speed selector switch. The other switch 98 of relay 88 is interposed between junctions 100 and 102 formed by the cut in line 104 of the lift truck's forward-reverse direction control circuit. Switch 98 is referred to herein as a direction-selector switch.

When both switches 90 and 98 are in their unactuated positions as shown in FIG. 3 due to the open condition of synchronizing switch 78, normal circuits are completed through both lines 96 and 104 of the lift truck's speed and direction-control circuits respectively, and speed and direction of the lift truck are controlled normally by the operator. However, upon the operator's actuation of push frame control valve 58 to extend cylinder 64 and thus the push frame, synchronizing switch 78 is closed in response to the supply of pressurized fluid to line 62. This completes a circuit through the time-delay relay assembly 88 which, after the initial time delay which has been preset in the relay 88, causes both relay switches 90 and 98 to move to the left in FIG. 3 thereby interrupting normal current flow through lift truck lines 96 and 104 respectively. Instead, speed selector switch 90 now directs current through line 106, through a variably settable resistor 108 and thence through line 110 to the SCR assembly 34, thereby replacing accelerator-controlled variable resistor 36 as the means for controlling speed of the motor 28 through the SCR assembly 34.

Concurrently with the above-described actuation of speed-selector switch 90, direction-selector switch 98 is also moved to the left in FIG. 3 thereby interrupting normal current flow through line 104 of the lift truck's direction-control circuit. Rather current is instead conducted through line 112 and line 112*a*, replacing switches 40 and 54 as the means by which drive direction is controlled. Such current is thereby conducted only to relay 50 which causes motor switches 46 and 48 to move to the left in FIG. 3 driving the lift truck in a rearward direction, the speed of rearward movement being fixed by the setting of variable resistor 108.

Proper adjustment and synchronization of the foregoing speed and direction control functions is preferably accomplished during installation of the accessory by first adjustably setting the flow rate through variable flow-control valve 72 so as to achieve the desired speed of extension of the push frame 22 relative to the lift truck. Once the flow-control valve 72 has been set, the push frame is extended and the delay, if any, between actuation of valve 58 and actual initiation of extension, due to retraction of cylinder 68 to release a slip sheet clamp if the truck is so equipped, is timed. The time-delay adjustment of relay 88 is then set so as to equal the observed time delay. Thereafter variable resistor 108 of the accessory is set so as to cause lift truck reverse speed to equal the preset speed of extension of the push frame 22 relative to the lift truck. Accordingly, merely by the operator's actuation of valve 58 to extend the push frame 22, the entire system will automatically be actuated to drive the lift truck rearwardly in a synchronized fashion with respect to push frame extension and at a reverse speed equal to the speed of extension.

Switches 82 and 84 of the accessory are both override switches which selectively permit or prevent actuation of the speed selection and direction control functions of the accessory. Switch 82 is merely a manually-controlled switch which the operator can open to prevent actuation of the system when extension of the push frame independently of any lift truck movement is desired. Switch 84 is controlled by relay 114 which is responsive to the flow of any current through switch 54 and line 104 of the lift truck's direction-control circuit. If such current is sensed, relay 114 opens switch 84 and prevents actuation of the system. This could occur, for example, if the valve 58 has been inadvertently actuated to extend the push frame while the operator is depressing the accelerator. Since the operator's depression of the accelerator can cause the truck to move during the time delay period set in relay 88, the truck could conceivably be moving forward at the time when the relay switch 98 causes the drive motor to drive the truck in reverse. However relay 114 and switch 84 sense any such potential conflict and interrupt the synchronous operation of the automatic functions before such a conflict can occur.

Switch 116 of the accessory selectively includes or eliminates a voltage step-down resistor 118 from the actuation circuits of the relays 88 and 114, and is provided to adapt the accessory for installation on lift trucks of different battery voltages. For example, switch 116 would bypass resistor 118 (as shown in FIG. 3) if the lift truck were equipped with a 36 volt battery capacity, but would be switched to its nonbypassing position during installation if the lift truck were equipped with a 48 volt battery capacity.

It should be noted that, although the system of the present invention is shown in its preferred form adapted to an electric lift truck, the principle of operation of the system could be adapted in an equivalent manner to a lift truck powered by an internal combustion engine by providing, for example, a hydraulically or electrically actuated drive speed control in the nature of a settable engine rpm governor which fixes engine rpm and thus vehicle speed, and a hydraulically or electrically actuated transmission direction controller which places the transmission in reverse, all automatically in response to extension of the push frame in the manner previously discussed.

The terms and expressions which have been employed in the foregoing specification are used therein as terms of description and not of limitation, and there is no intention, in the use of such terms and expressions of excluding equivalents of the features shown and described or portions thereof, it being recognized that the scope of the invention is defined and limited only by the claims which follow.

What is claimed is:

1. In a lift truck having a prime mover for selectively driving said lift truck rearwardly, first speed control means associated with said prime mover for variably controlling the speed at which said lift truck is driven rearwardly by said prime mover, a load-carrying member extending forwardly from said lift truck, a selectively extensible and retractable push frame mounted on said lift truck for pushing a load from said load-carrying member in a direction forwardly of said lift truck by extension of said push frame with respect to said lift truck and selectively actuated push frame power means connected to said push frame for extending said push frame, the improvement which comprises means connected to said push frame power means for causing said push frame power means to extend said push frame at a speed of extension with respect to said lift truck, second speed control means associated with said prime mover for causing said prime mover to drive said lift truck rearwardly at a reverse speed substantially equal to said speed of extension of said push frame and selectively controlled speed selector means for alternately causing either said first or said second speed control means operatively to control the speed at which said lift truck is driven rearwardly by said prime mover.

2. The lift truck of claim 1 including means responsively connecting said speed selector means to said push frame power means for actuating said speed selector means to cause said second speed control means to control rearward speed of said lift truck in response to actuation of said push frame power means to extend said push frame.

3. The lift truck of claim 1 wherein said prime mover is an electric motor, said first speed control means comprises first electrical circuit means for controlling the supply of electrical power to said electric motor, said second speed control means comprises second electrical circuit means for controlling the supply of electrical power to said electric motor, and said selectively controlled speed selector means comprises switch means for alternatively conducting electrical current to either said first electrical circuit means or to said second electrical circuit means.

4. The lift truck of claim 1 further including first direction control means associated with said prime mover for selectively causing said prime mover to drive said lift truck alternatively in either a forward or reverse direction, second direction control means associated with said prime mover for causing said prime mover to drive said lift truck only in a rearward direction, and selectively controlled direction selector means for alternatively causing either said first or second direction control means operatively to control the direction in which said lift truck is driven by said prime mover.

5. The lift truck of claim 4 wherein said prime mover is an electric motor, said first direction control means comprises first electrical circuit means for conducting electrical current to said electric motor alternatively for driving said electric motor in either of two directions, said second direction control means comprises second electrical circuit means for conducting electrical current to said electric motor for driving said electric motor only in a single direction, and said selectively controlled direction selector means comprises switch means for alternatively conducting electrical current to either said first electrical circuit means or to said second electrical circuit means.

6. The lift truck of claim 4 including means responsively connecting said direction selector means to said push frame power means for actuating said direction selector means to cause said second direction control means to control the direction of said lift truck in response to actuation of said push frame power means to extend said push frame.

7. The lift truck of claim 1 wherein said means connected to said push frame power means includes means for causing said push frame power means to extend said push frame at a speed of extension of fixed, predetermined magnitude with respect to said lift truck, and wherein said second speed control means includes means for causing said prime mover to drive said lift truck rearwardly at a reverse speed of fixed, predetermined magnitude substantially equal to said fixed, predetermined magnitude of said speed of extension of said push frame.

8. The lift truck of claim 7 wherein said selectively actuated means includes means for variably adjusting said fixed, predetermined speed of extension of said push frame, and means for variably adjusting said fixed, predetermined reverse speed of said lift truck so as to equal said predetermined speed of extension.

9. In a lift truck having a prime mover for selectively driving said lift truck rearwardly, a load-carrying member extending forwardly from said lift truck, a selectively extensible and retractable push frame mounted on said lift truck for pushing a load from said load-carrying member in a direction forwardly of said lift truck by extension of said push frame with respect to said lift truck and selectively actuated push frame power means connected to said push frame for extending said push frame, the improvement which comprises selectively actuated means connected to said push frame power means and prime mover respectively for causing said push frame power means to extend said push frame at a fixed, predetermined speed of extension with respect to said lift truck while simultaneously causing said prime mover to drive said lift truck rearwardly at a fixed, predetermined reverse speed substantially equal to said fixed, predetermined speed of extension of said push frame and synchronizing means responsively connected to said push frame power means for actuating said selectively actuated means in response to actuation of said push frame power means to extend said push frame.

10. The lift truck of claim 9 wherein said synchronizing means includes time delay means for delaying actuation of said prime mover to drive said lift truck rearwardly in response to said actuation of said push frame power means by a predetermined time period after said actuation of said push frame power means.

11. The lift truck of claim 10 wherein said time delay means includes means for variably adjusting said predetermined time period.

12. The lift truck of claim 9 including selectively controlled means connected to said synchronizing means for alternatively causing or preventing actuation of said selectively actuated means in response to said actuation of said push frame power means.

13. The lift truck of claim 12 wherein said push frame power means includes means for selectively extending said push frame while said lift truck is not being driven by said prime mover.

14. In a lift truck having a prime mover for selectively driving said lift truck rearwardly, a load-carrying member extending forwardly from said lift truck, a selectively extensible and retractable push frame mounted on said lift truck for pushing a load from said load-carrying member in a direction forwardly of said lift truck by extension of said push frame with respect to said lift truck and selectively actuated push frame power means connected to said push frame for extending said push frame at a speed of extension with respect to said lift truck, the improvement which comprises synchronizing means connecting said prime mover responsively to said push frame power means for actuating said prime mover to drive said lift truck rearwardly in response to actuation of said push frame power means to extend said push frame.

15. The lift truck of claim 14 wherein said synchronizing means includes time delay means for delaying the actuation of said prime mover means in response to said actuation of said push frame power means by a predetermined time period after said actuation of said push frame power means.

16. The lift truck of claim 15 wherein said time delay means includes means for variably adjusting said predetermined time period.

17. The lift truck of claim 14 including selectively controlled means connected to said synchronizing means for alternatively causing or preventing actuation of said prime mover to drive said lift truck in response to said actuation of said push frame power means.

18. The lift truck of claim 17 wherein said push frame power means includes means for selectively extending said push frame while said lift truck is not being driven by said prime mover.

19. An accessory for a lift truck having a prime mover for selectively driving said lift truck rearwardly, a load-carrying member extending forwardly from said lift truck, a selectively actuated push frame for pushing a load forwardly off of said load-carrying member upon extension of said push frame relative to said lift truck and selectively actuated push frame power means for selectively extending said push frame with respect to said lift truck, said accessory comprising:

(a) push frame speed control means for fixing, at a first predetermined speed, the speed at which said push frame power means extends said push frame with respect to said lift truck;

(b) means for operatively connecting said push frame speed control means to said push frame power means so as to control the speed of extension of said push frame;

(c) selectively actuated lift truck speed control means for fixing, at a second predetermined speed substantially equal to said first predetermined speed, the speed at which said lift truck is driven rearwardly by said prime mover;

(d) means for operatively connecting said lift truck speed control means to said prime mover so as to control the rearward speed of said lift truck;

(e) selectively actuated direction control means for causing said prime mover to drive said lift truck in a rearward direction;

(f) synchronizing means for actuating said lift truck speed control means and direction control means in response to actuation of said push frame power means to extend said push frame;

(g) means for connecting said synchronizing means responsively to said push frame power means; and (h) means for operatively connecting said direction control means to said prime mover so as to control the direction in which said prime mover drives said lift truck.

20. The accessory of claim 19 including adjustable means connected to said push frame speed control means for variably adjusting said first predetermined speed, and means connected to said lift truck speed control means for variably adjusting said second predetermined speed to equal said first predetermined speed.

21. The accessory of claim 19 wherein said synchronizing means includes time delay means for delaying the actuation of said direction control means in response to said actuation of said push frame power means by a predetermined time period after said actuation of said push frame power means.

22. The lift truck of claim 21 wherein said time delay means includes means for variably adjusting said predetermined time period.

23. The accessory of claim 19, further including selectively controlled means connected to said synchronizing means for alternatively causing or preventing actuation of said direction control means in response to said actuation of said push frame power means.

24. An accessory for a lift truck having a prime mover for selectively driving said lift truck rearwardly, a load-carrying member extending forwardly from said lift truck, a selectively actuated push frame for pushing a load forwardly off of said load-carrying member upon extension of said push frame relative to said lift truck and selectively actuated push frame power means for selectively extending said push frame with respect to said lift truck, said accessory comprising:

(a) push frame speed control means for fixing, at a first predetermined speed, the speed at which said push frame power means extends said push frame with respect to said lift truck;

(b) means for operatively connecting said push frame speed control means to said push frame power means so as to control the speed of extension of said push frame;

(c) selectively actuated lift truck speed control means for fixing, at a second predetermined speed substantially equal to said first predetermined speed, the speed at which said lift truck is driven rearwardly by said prime mover;

(d) means for operatively connecting said lift truck speed control means to said prime mover so as to control the rearward speed of said lift truck;

(e) a further lift truck speed control means for permitting the speed of said lift truck to be variably controlled and means for connecting said further lift truck speed control means operatively to said prime mover bypassing the other lift truck speed control means; and (f) selectively controlled speed selector means for alternately causing one or the other of said repective lift truck speed control means to control the speed at which said lift truck is driven rearwardly by said prime mover.

25. The accessory of claim 24 for a lift truck having an electric motor as said prime mover, wherein each of said respective lift truck speed control means comprises electrical circuit means for controlling the supply of electrical power to said electric motor, further including means for operatively connecting said respective electrical circuit means to said electric motor in parallel with each other, said speed selector means comprising selectively controlled switch means for alternatively conducting electrical current to one or the other of said electrical circuit means.

26. An accessory for a lift truck having a prime mover for selectively driving said lift truck rearwardly, a load-carrying member extending forwardly from said lift truck, a selectively actuated push frame for pushing a load forwardly off of said load-carrying member upon extension of said push frame relative to said lift truck and selectively actuated push frame power means for selectively extending said push frame with respect to said lift truck, said accessory comprising:

(a) selectively actuated direction control means for causing said prime mover to drive said lift truck in a rearward direction;

(b) means for operatively connecting said direction control means to said prime mover so as to control the direction in which said prime mover drives said lift truck;

(c) synchronizing means connected to said direction control means for actuating said direction control means in response to actuation of said push frame power means to extend said push frame; and (d) means for responsively connecting said synchronizing means to said push frame power means.

27. The accessory of claim 26 wherein said synchronizing means includes time-delay means for delaying the actuation of said direction control means in response to actuation of said push frame power means by a predetermined time period after said actuation of said push frame power means.

28. The accessory of claim 27 wherein said time-delay means includes means for variably adjusting said predetermined time period.

29. The accessory of claim 26, further including selectively controlled means connected to said synchronizing means for alternatively causing or preventing actuation of said direction control means in response to said actuation of said push frame power means.

30. The accessory of claim 26 including a further direction control means for permitting said prime mover to drive said lift truck in either a forward or reverse direction and means for connecting said further direction control means operatively to said prime mover bypassing the other direction control means, and selectively controlled direction selector means for alternatively causing one or the other of said respective direction control means to control the direction in which said lift truck is driven by said prime mover.

31. The accessory of claim 30 for a lift truck having an electric motor as said prime mover, wherein each of said respective direction control means comprises electrical circuit means for conducting electrical current to said electric motor, further including means for operatively connecting said respective electrical circuit means to said electric motor in parallel with each other, said direction selector means comprising selectively controlled switch means for alternatively conducting electrical current to one or the other of said electrical circuit means.

32. The accessory of claim 31 wherein said switch means is controllably connected to said synchronizing means.

* * * * *